US008807146B2

(12) United States Patent
Sobol

(10) Patent No.: US 8,807,146 B2
(45) Date of Patent: Aug. 19, 2014

(54) HOUSING BASE AND ASSOCIATED HOUSING AND ASSEMBLY METHOD

(75) Inventor: Yevsey Sobol, Staten Island, NY (US)

(73) Assignee: Qualipac, Neuilly sur Seine (FR)

( * ) Notice: Subject to any disclaimer, the term of this patent is extended or adjusted under 35 U.S.C. 154(b) by 0 days.

(21) Appl. No.: 13/579,363

(22) PCT Filed: Mar. 8, 2011

(86) PCT No.: PCT/IB2011/000495

§ 371 (c)(1),
(2), (4) Date: Aug. 16, 2012

(87) PCT Pub. No.: WO2011/110922

PCT Pub. Date: Sep. 15, 2011

(65) Prior Publication Data

US 2013/0000667 A1 Jan. 3, 2013

Related U.S. Application Data

(60) Provisional application No. 61/311,435, filed on Mar. 8, 2010.

(30) Foreign Application Priority Data

Mar. 8, 2010 (FR) ..... 10 51659

(51) Int. Cl.
*A45D 24/00* (2006.01)
*A45D 7/00* (2006.01)

(Continued)

(52) U.S. Cl.
CPC ..... *A45D 33/006* (2013.01); *A45D 40/22* (2013.01); *Y10S 206/823* (2013.01); *Y10S 220/26* (2013.01)
USPC ..... 132/200; 132/293; 132/294; 132/315; 206/581; 206/823; 220/23.83; 220/DIG. 26; 215/12.1; 215/10

(58) Field of Classification Search
CPC .... A45C 11/008; A45C 5/005; A45D 33/006; A45D 33/025; A45D 33/003; A45D 33/16; A45D 40/22; B65D 21/0233; B65D 21/0222; B65D 21/0223; B65D 7/22; B65D 5/66; B65D 3/24
USPC ..... 132/293, 200, 286, 294–296, 297, 301, 132/303, 314, 315, 316; 206/581, 823, 235, 206/485, 477, 486, 487, 426, 483, 482, 206/485.1, 562, 564, 565; 220/4.22, 4.23, 220/4.27, 4.29, 4.31, 4.32, 532, 533, 544, 220/23.88, 23.83, 23.87, 302, 527, 528; 215/12.1, 43, 44, 6, 10; 403/345, 410
See application file for complete search history.

(56) References Cited

U.S. PATENT DOCUMENTS 3,156,279 A * 11/1964 Grebowiec et al. ..... 215/12.1

(Continued)

FOREIGN PATENT DOCUMENTS

EP 1 598 283 A1 11/2005

(Continued)

*Primary Examiner* — Vanitha Elgart
(74) *Attorney, Agent, or Firm* — IM IP Law PLLC; C. Andrew Im

(57) ABSTRACT

The invention relates to a housing base suitable for containing a cosmetic product and comprises a compartment, a part, a first hollow element, a second protruding element, a third hollow element and a fourth protruding element. The compartment comprises a bottom and a lateral wall. The part for containing a cosmetic product is embedded in the compartment and comprises a bottom and a lateral wall. The first hollow element is fitted with a second protruding element and the hollow element is fitted with a fourth protruding element. One of the first or second elements is fitted into the lateral wall of the compartment and the other is fitted into the lateral wall of the part. One of the third or fourth elements is fitted into the bottom of the compartment and the other being fitted into the bottom of the part.

9 Claims, 1 Drawing Sheet

(51) Int. Cl.

| | |
|---|---|
| ***A45D 33/24*** | (2006.01) |
| ***A45D 33/26*** | (2006.01) |
| ***A45D 33/00*** | (2006.01) |
| ***A45D 27/22*** | (2006.01) |
| ***B65D 43/14*** | (2006.01) |
| ***B65D 69/00*** | (2006.01) |
| ***B65D 71/00*** | (2006.01) |
| ***B65D 21/02*** | (2006.01) |
| ***B65D 23/00*** | (2006.01) |
| ***B65D 21/00*** | (2006.01) |
| ***A45D 40/22*** | (2006.01) |
| *A47G 19/00* | (2006.01) |
| *A47J 41/02* | (2006.01) |

(56) References Cited

U.S. PATENT DOCUMENTS

| | | | | | |
|---|---|---|---|---|---|
| 3,311,248 | A * | 3/1967 | Marchant | 215/13.1 |
| 3,650,427 | A * | 3/1972 | Franklin | 215/12.1 |
| 3,760,985 | A * | 9/1973 | Bryan | 222/136 |
| 3,847,494 | A * | 11/1974 | Franklin | 403/345 |
| 3,871,543 | A * | 3/1975 | Chadfield et al. | 215/12.1 |
| 6,076,679 | A * | 6/2000 | Yuhara et al. | 206/581 |
| 6,311,701 | B1 * | 11/2001 | Yuhara et al. | 132/294 |
| 6,345,627 | B1 * | 2/2002 | Petit | 132/293 |
| 6,729,472 | B2 * | 5/2004 | Stucke et al. | 206/515 |
| 7,819,125 | B2 * | 10/2010 | Maelstaf | 132/293 |
| 7,832,564 | B2 * | 11/2010 | Kim | 206/581 |
| 7,878,212 | B2 * | 2/2011 | Ubertifoppa | 132/294 |
| 7,997,285 | B2 | 8/2011 | Fischer et al. | |
| 2005/0258126 | A1 * | 11/2005 | Canamasas Puigbo | 215/12.1 |
| 2009/0272399 | A1 * | 11/2009 | Kim | 132/293 |

FOREIGN PATENT DOCUMENTS

| | | |
|---|---|---|
| EP | 1 645 205 A1 | 4/2006 |
| FR | 2 741 042 A1 | 5/1997 |

* cited by examiner

HOUSING BASE AND ASSOCIATED HOUSING AND ASSEMBLY METHOD

RELATED APPLICATIONS

This application is a §371 application from PCT/IB2011/000495 filed Mar. 8, 2011, which claims priority from French Patent Application No. 10 51659 filed Mar. 8, 2010 and claims benefit of U.S. Provisional Application No. 61/311,435 filed Mar. 8, 2010, each of which is incorporated herein by reference in its entirety.

TECHNICAL FILED OF THE INVENTION

This invention relates to the field of housings, in particular those aimed at containing cosmetic products.

BACKGROUND OF THE INVENTION

Such a housing generally comprises a base aimed at accommodating the cosmetic products and a lid suitable for enabling access or closing access to the cosmetic products present in the base according to whether the lid is in an open or closed position.

The base generally comprises a support with one or several compartments, and parts fitted into these compartments and aimed at containing cosmetic products. These parts are, for example, inserts.

It is preferable to prevent the parts from falling out of the compartments in the event of the housing being dropped, an impact being applied to the housing. It is also preferable to ensure that the parts are resistant to a vertical pulling force and/or rotation around a horizontal axis, above a determined limit. To achieve these goals, anchor points are used to lock the parts embedded in the compartments.

To this effect, for example, the anchor points between the parts and the compartments are known to include welding points or gluing points.

There is a need to limit the anchor points as much as possible, in particular due to the increasing use of transparent materials in manufacturing the support comprising the compartments and parts.

OBJECT AND SUMMARY OF THE INVENTION

In a first aspect, the invention relates to a housing base suitable for containing a cosmetic product, including:

- a compartment fitted into a support and comprising a bottom and at least one lateral wall;
- a part embedded in the compartment and suitable for containing the cosmetic product, said part comprising a bottom positioned on the bottom of the compartment and located parallel to said compartment bottom and comprising at least one lateral wall positioned parallel to the lateral wall of the compartment;
- locking means suitable for locking the part embedded in the compartment, by preventing relative movements of said part and said compartment along a first axis perpendicular to the bottoms of said part and compartment,
- said locking means comprising a first hollow element fitted with a second protruding element of a shape complementary to the first element, one of the first or second elements being fitted into the lateral wall of the compartment and the other being fitted into the lateral wall of the part;
- locking means suitable for locking the part embedded in the compartment, by preventing relative movements of said part and said compartment along a second axis perpendicular to the lateral wall, as well as preventing a rotation of the said part with respect to said compartment around a third axis perpendicular to first and second axes,
- said locking means comprising a third hollow element fitted with a fourth protruding element of a shape complementary to the third element, one of the third or fourth elements being fitted into the bottom of the compartment and the other being fitted into the bottom of the part.

The locking means including the first and second elements enable the relative movements of the part with regard to the compartment and perpendicular to the bottoms to be prevented, whereas the locking means comprising the third and fourth elements enable the relative movements of the part with regard to the compartment and perpendicular to the lateral wall, as well as the relative rotating movement of the part with regard to the compartment, to be prevented. An increase in the number of anchor points between the lateral walls of the part and of the compartment is therefore unnecessary.

Such a housing base enables the locking of the part embedded in the compartment to be ensured while reducing the number of anchor points between the lateral wall of the compartment and that of the part.

In an embodiment of the invention, the first element includes at least one fin formed on the lateral wall of the part. This feature enables a particularly efficient locking mechanism to be created between the part and the compartment while limiting the number of anchor points.

In an embodiment of the invention, the bottom of the part and the bottom of the compartment are in contact with each other at the level of the third and fourth elements, and are separated by a space on at least one part of said bottoms. This feature avoids giving rise to the development of the "water drop" effect caused by crushing an opaque material (for example the part) against a transparent material (for example the support that makes up the bottom of the compartment), while avoiding vertical clearance—i.e. perpendicular to the bottoms—between the compartment and the part.

In an embodiment of the invention, the third element is a trough. This feature enables a particularly efficient locking mechanism to be created between the part and the compartment while limiting the number of anchor points.

In an embodiment of the invention, the third element is located in the extension of the lateral wall of the part. This layout enables a particularly efficient locking mechanism to be created between the part and the compartment while limiting the number of anchor points.

In a second aspect, the invention relates to a housing suitable for containing a cosmetic product, including:

- a base as per the first aspect of the invention; and
- a lid suitable for covering at least one part of the base in a closed position and for enabling access to said part of the base in an open position.

In a third aspect, the invention relates to a method for assembling a housing base suitable for containing a cosmetic product,

- said base including at least one compartment fitted into a support, said compartment comprising:
  - at least one lateral wall with one element from among a first hollow element and a second protruding element of complementary shapes and
  - a bottom with one element from among a third hollow element and a fourth protruding element of complementary shapes, said base also including a part suitable for containing a cosmetic product and suitable for being embedded into the compartment, said base comprising:

at least one lateral wall with the other element from among the first hollow element and the second protruding element, and a bottom with the other element from among the third hollow element and the fourth protruding element, the method including the following steps:

the part is placed directly above the compartment, the bottom of the part being positioned parallel to the bottom of the compartment and a pressure perpendicular to said bottoms is applied so as to embed the part into the compartment;

when embedding this part, the lateral wall of the part slides along the lateral wall of the compartment until the first element and the second element connect together and until the third element and the fourth element connect together in such a way as to lock the part embedded in the compartment.

BRIEF DESCRIPTION OF THE DRAWINGS

Other characteristics and advantages of the invention will be discovered after reading the following description. This is purely for illustrational purposes and must be read using the appended figures, in which.

DETAILED DESCRIPTION OF THE EMBODIMENTS

Figure 1A:
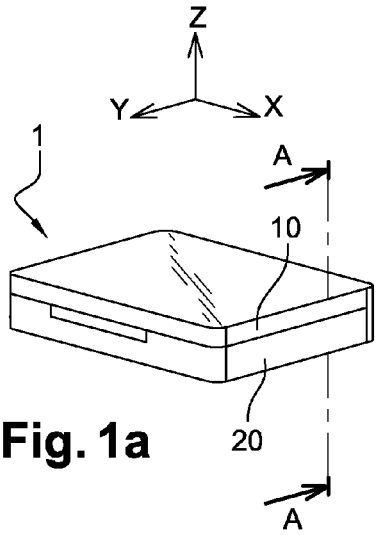
FIG. 1*a* represents a housing with the lid in a closed position in one embodiment of the invention.
Figure 1B:
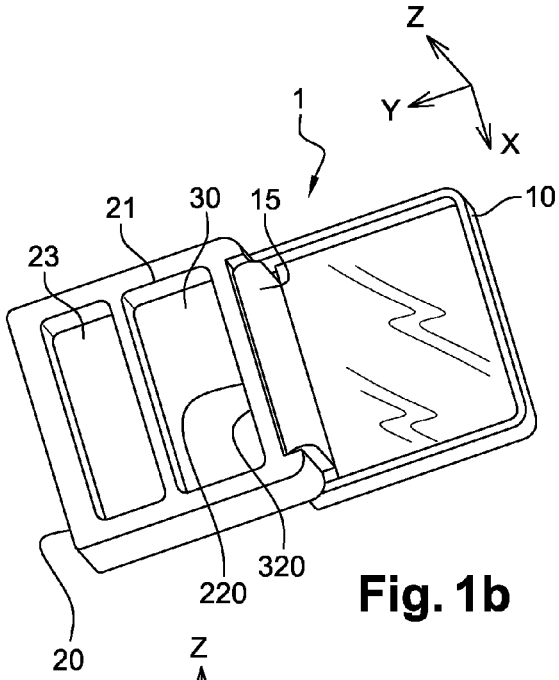
FIG. 1*b* represents the housing in FIG. 1*a* with the lid in an open position.

FIG. 1*a* and FIG. 1*b* respectively represent a view in perspective of a housing 1 in an embodiment of the invention, with the lid in a closed position and the lid in an open position respectively.

The top of housing 1 includes a lid 10 and the bottom of the housing includes a base 20. The purpose of base 20 is to accommodate cosmetic products.

For a better comprehension of the following description, an orthogonal basis of 3 axes (X, Y, Z) is considered. The base 20 has a flat bottom, perpendicular to axis Z.

Lid 10 can be closed on base 20 in order to protect the cosmetic products and prevent access, and can be opened to enable access. The opening and closing actions are performed by rotating lid 10 with regard to base 20 with the use of a hinge 15 connecting the lid 10 to the base 20.

Figure 2:
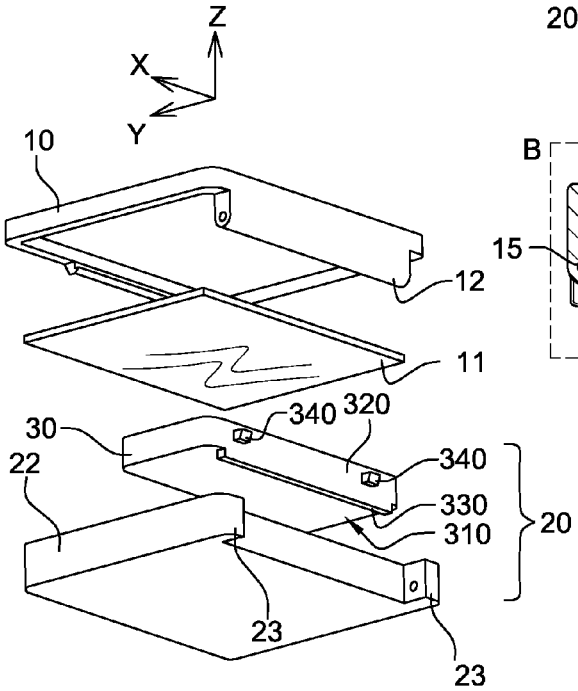
FIG. 2 represents different elements of the housing represented in FIGS. 1*a* and 1*b;*

FIG. 2 represents a view in perspective of the components of housing 1 before assembly. Thus, lid 10 comprises a side facing the inside of the housing, onto which a mirror 11 is attached, for example by glue. Lid 10 also comprises a rotation axis 12, which is parallel to axis X.

Base 20 includes a support 22. This support 22 comprises legs 23 aimed at creating a hinge connection 15 with axis 12 of the lid 10. Support 22 also has compartments 21 and 23. The purpose of compartment 21 is, for example, to accommodate a brush or a part containing make-up. Base 20 also includes a part 30 aimed at containing make-up or a brush, and suitable for being tightly embedded into compartment 21.

Figure 3:
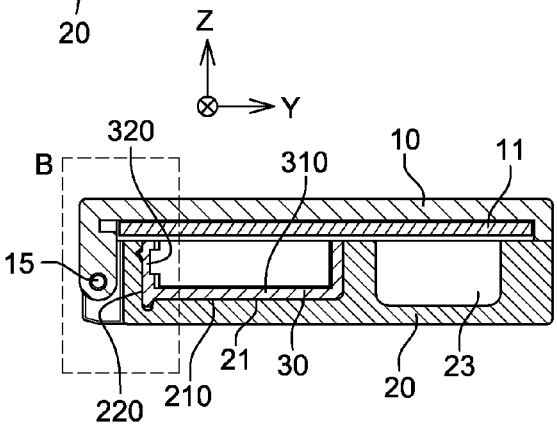
FIG. 3 represents a transversal cross-section according to AA of the housing represented in FIG. 1*a*.

FIG. 3 represents a transversal cross-section of the housing 1 with the lid 10 in a closed position as illustrated in FIG. 1*a*, according to a plane (Y, Z) perpendicular to the plane (X, Y) in which the base 20 is located and passing by the line AA represented in FIG. 1*a*.

Figure 4:
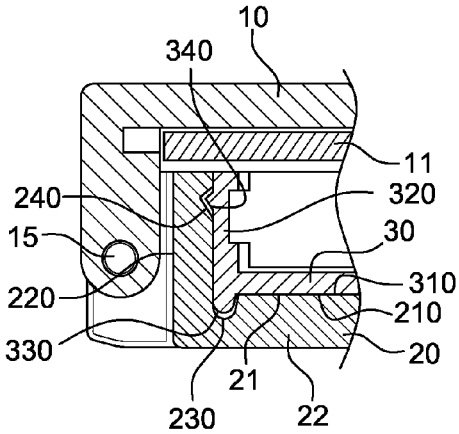
FIG. 4 represents a magnified view of frame B of FIG. 3.

FIG. 4 represents a magnified view of frame B of FIG. 3.

Compartment 21 and part 30 have substantially the same dimensions in such a way as to enable part 30 to be tightly embedded into compartment 21.

Compartment 21 comprises a bottom 210 located in the plane (X, Y), in this case rectangular in shape, and four lateral walls enclosing the bottom 210 and perpendicular to this bottom 210, thus defining compartment 21. In the example represented, each set of two opposing walls are parallel.

Part 30 also comprises a bottom 310 located in the plane (X, Y), rectangular in shape, and four lateral walls, each set of two opposing walls being parallel, enclosing the bottom 310 and perpendicular to bottom 310, thus defining a cavity in which the make-up product will be placed.

Each lateral wall of compartment 21 is positioned parallel to, and against a corresponding lateral wall of part 30.

Thus, the lateral wall 220 of compartment 21, closest to hinge 15 and which is located parallel to this hinge, is positioned against the lateral wall 320 of part 30.

The lateral wall 320 of part 30 has two fins 340.

Each fin 340 protrudes with regard to the plane of the lateral wall 320 of part 30 and in the direction of the lateral wall 220 of compartment 21.

The lateral wall 220 of compartment 21 has two hollows 240 opposite the fins 340, hollow with regard to the plane of the lateral wall 220 of compartment 21 and suitable for embedding the fins 340.

This embedment between hollows 240 and the corresponding fins 340 creates a locking mechanism for part 30 embedded in compartment 21, by preventing the relative movements of part 30 and compartment 21 along axis Z.

In addition, bottom 210 of compartment 21 has a trough 230.

In this case, trough 230 fitted into the bottom 210 of compartment 21 is located parallel to the lateral wall 220.

Bottom 310 of part 30 includes a tongue 330 opposite trough 230 and suitable for being embedded into trough 230. Tongue 330 protrudes with regard to the plane of the bottom 310 of part 30 and in the direction of the bottom 210 of compartment 21.

In the embodiment represented on FIG. 4, tongue 330 is also fitted into the extension of the lateral wall 220, as is trough 230, in which tongue 330 is embedded. In another embodiment, the trough on the bottom of the compartment and the tongue on the bottom of the part can be located outside of the plane of the lateral wall of the part.

The embedment between tongue 330 and trough 230 creates a locking mechanism for part 30 embedded in compartment 21 by preventing a rotational movement of part 30 around axis X with regard to compartment 21, which would cause the fins 340 to become displaced from the hollows 240.

Moreover, the embedment between tongue 330 and trough 230 creates a locking mechanism for part 30 embedded in compartment 21 by preventing the relative movements of part 30 and compartment 21 along axis Y.

In this embodiment, the embedment of part 30 in compartment 21 is only locked by the anchor points that constitute on the one hand the set of components comprised of the trough 230 and tongue 330, and on the other hand the set of components comprised of the fins 340 and hollows 240.

In this embodiment, the anchor points are therefore only positioned on the lateral wall 220 of compartment 21 and the lateral wall 320 of part 30, which are opposite hinge 15 connecting the lid and the base, as well as on the bottoms 210 and 310: no anchor point is required on the other lateral walls of compartment 21 or part 30.

Such a locking mechanism is efficient and visually very discrete. It is therefore compatible with support 22 being manufactured from transparent, plastic material.

The base as described in the embodiment above comprises two compartments and the anchor points according to the invention have been made on one of the compartments comprising a rectangular bottom. Nevertheless, the invention can be implemented with any number of compartments and varied in shape.

In the embodiment presented in reference to the figures, the protruding elements are manufactured on the part and the hollow elements in the compartment.

The invention can be implemented with at least some protruding elements manufactured on the compartment and corresponding hollow elements manufactured in the part.

In addition, in the embodiment presented in reference to the figures, the locking elements with regard to movement along axis Z, which are either protruding elements or hollow elements with regard to the lateral walls, are two fins and the corresponding hollows. In another embodiment, they are one, two or more in number. In addition, these hollow and protruding elements can have different shapes: for example troughs/grains extending along the walls etc.

Similarly, in the embodiment presented in reference to the figures, the locking elements with regard to a rotation around axis X of the part with regard to the compartment, which are either protruding elements or hollow elements with regard to the bottoms, are a tongue and a corresponding trough. These hollow and protruding elements can have different shapes: for example one or several sets of hollows/corresponding fins positioned on the bottoms.

In one embodiment, the bottom of the compartment and the bottom of the part are in contact with each other at the level of the trough and tongue, and comprise a clearance between at least one part of the bottoms. This layout avoids giving rise to the development of the "water drop" effect caused by crushing an opaque material (for example part 30) against a transparent material (for example support 22 that makes up the bottom of compartment 21).

A housing with the characteristics of the invention also has the advantage that the locking mechanism for the part embedded in the compartment is created simply by assembling these two elements, without any additional operation such as bonding or welding.

Indeed, when assembling the base 20 of the housing, part 30 is positioned directly above compartment 21 fitted into support 22 as represented in FIG. 2, the bottoms 210 and 310 of compartment 21 and part 30 being parallel to each other, and a pressure is applied along axis Z in such a way as to embed part 30 into compartment 21.

The lateral walls of part 30 will slide against the lateral walls of compartment 21. The lateral wall 320 with fins 340 will become slightly deformed elastically when the fins slide on the lateral wall 220 of compartment 21 and this until the fins penetrate hollows 240, tongue 330 protruding from bottom 310 of part 30 also being therefore embedded into trough 230 fitted into bottom 210 of compartment 21.

The invention presented above applies to a housing base, a compartment and a part, parallelepiped in shape. Nonetheless, it can also be applied to bases, compartments and parts with various shapes.

The invention claimed is:

1. A housing base for containing a cosmetic product, comprising:

a compartment fitted into a support and comprising a bottom and at least one lateral wall;

a lid connected to legs of the base to provide a hinge connection so that the lid rotates to open and close the housing base;

a part for containing the cosmetic product and embedded in the compartment, the part comprising a bottom positioned on and parallel to the bottom of the compartment and at least one lateral wall positioned parallel to the lateral wall of the compartment;

a first locking means for locking the part embedded in the compartment by preventing relative movements of the part and the compartment along a first axis (Z) perpendicular to the bottoms of the part and compartment, and wherein the first locking means comprises a first hollow element fitted with a second protruding element of a shape complementary to the first element, the first hollow element being fitted into the lateral wall of the compartment and the second protruding element being fitted into the lateral wall of the part, wherein the second protruding element is configured to deform elastically to permit the lateral wall of the part to slide along the lateral wall of the compartment to connect the first hollow element and the second protruding element; and a second locking means for locking the part embedded in the compartment by preventing relative movements of the part and the compartment along a second axis (Y) perpendicular to the lateral wall and preventing a rotation of the part with respect to the compartment around a third axis (X) perpendicular to first and second axes, and wherein the second locking means comprises a third hollow element fitted with a fourth protruding element of a shape complementary to the third element, the third hollow element being fitted into the bottom of the compartment and the fourth protruding element being fitted into the bottom of the part.

2. The housing base of claim 1, wherein the second element comprises at least one fin formed on the lateral wall of the part.

3. The housing base of claim 2, wherein the bottom of the part and the bottom of the compartment are in contact with each other at the level of the third and fourth elements, and are separated by a space on at least one part of the bottoms.

4. The housing base of claim 1, wherein the third element is a trough.

5. The housing base of claim 1, wherein the fourth element is located in an extension of the lateral wall of the part.

6. A method for assembling a housing base for containing a cosmetic product, wherein the base comprises at least one compartment fitted into a support and a part for containing the cosmetic product and suitable for being embedded into the compartment;

wherein the compartment comprises at least one lateral wall with a first hollow element and a bottom with a third hollow element;

wherein the part comprises at least one lateral wall with a second protruding element having a shape complementary to the first hollow element and a bottom with a fourth protruding element having a shape complementary to the third hollow element; and the method comprising the steps of:

positioning the part of the housing base directly above the compartment;

positioning the bottom of the part parallel to the bottom of the compartment;

applying a pressure perpendicular to the bottom of the part and the bottom of the compartment to embed the part into the compartment;

sliding the lateral wall of the part along the lateral wall of the compartment and elastically deforming the second protruding element until the first and second elements connect together and until the third and fourth elements connect together to lock the part embedded in the compartment to prevent relative movements of the part and the compartment along a first axis (Z) perpendicular to the bottoms of the part and to prevent relative movements of the part and compartment and along a second axis (Y) perpendicular to the lateral wall of the part; and connecting a lid to legs of the housing base to provide a hinge connection so that the lid rotates to open and close the housing base.

7. The method of claim 6, wherein the second element comprises at least one fin formed on the lateral wall of the part.

8. The method of claim 6, wherein the third element is a trough.

9. The method of claim 6, further comprising the step of positioning the fourth element in an extension of the lateral wall of the part.

* * * * *